US009827764B2

(12) United States Patent
Takino et al.

(10) Patent No.: US 9,827,764 B2
(45) Date of Patent: Nov. 28, 2017

(54) LIQUID EJECTING HEAD AND LIQUID EJECTING APPARATUS WITH IMPROVED MECHANICAL STRENGTH

(71) Applicant: SEIKO EPSON CORPORATION, Tokyo (JP)

(72) Inventors: Fumiya Takino, Shiojiri (JP); Shunsuke Watanabe, Matsumoto (JP); Kenta Anegawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/078,577

(22) Filed: Mar. 23, 2016

(65) Prior Publication Data

US 2016/0279938 A1 Sep. 29, 2016

(30) Foreign Application Priority Data

Mar. 26, 2015 (JP) ..... 2015-064143
Feb. 5, 2016 (JP) ..... 2016-020627

(51) Int. Cl.
*B41J 2/14* (2006.01)

(52) U.S. Cl.
CPC .. *B41J 2/14233* (2013.01); *B41J 2002/14241* (2013.01); *B41J 2002/14306* (2013.01); *B41J 2002/14419* (2013.01); *B41J 2202/11* (2013.01)

(58) Field of Classification Search
CPC ..... B41J 2/055; B41J 2/17556; B41J 2002/14306; B41J 2/14016; B41J 2/0453; B41J 2/14048; B41J 2/14; B41J 2/1433; B41J 2002/14193
See application file for complete search history.

(56) References Cited

U.S. PATENT DOCUMENTS 5,638,097 A * 6/1997 Takayanagi ..... B41J 25/34 347/14
2008/0165228 A1* 7/2008 Kang ..... B41J 2/055 347/68
2010/0020136 A1* 1/2010 Lee ..... B41J 2/1404 347/85
2013/0127956 A1* 5/2013 Watanabe ..... B41J 2/055 347/71

FOREIGN PATENT DOCUMENTS

JP 2013-129191 7/2013

* cited by examiner

*Primary Examiner* — Henok Legesse
(74) *Attorney, Agent, or Firm* — Workman Nydegger

(57) ABSTRACT

A liquid ejecting head includes a pressure chamber substrate in which a pressure chamber space is formed, a flow path substrate having a first surface on which the pressure chamber substrate is installed and a second surface that is on the opposite side to the first surface, and in which a first space, a supply hole that enables communication between the first space and the pressure chamber space, and a communication hole that communicates with the pressure chamber space are formed, a nozzle plate that is installed on the second surface and in which a nozzle that communicates with the communication hole is formed, a second space that is installed on the first surface and that communicates with the first space of the flow path substrate, a housing unit in which an opening portion that communicates with the second space is formed, a compliance unit that is flexible and installed on the second surface and that seals the communication hole and the first space, and a beam-like portion that extends between inner wall surfaces of the second space in the housing unit.

6 Claims, 9 Drawing Sheets

LIQUID EJECTING HEAD AND LIQUID EJECTING APPARATUS WITH IMPROVED MECHANICAL STRENGTH

The entire disclosure of Japanese Patent Application No: 2015-064143, filed Mar. 26, 2015 and 2016-020627, filed Feb. 5, 2016 are expressly incorporated by reference herein in its entirety.

BACKGROUND

1. Technical Field

The present invention relates to a technology for ejecting liquid such as ink.

2. Related Art

To date, a liquid ejecting head has been proposed that ejects, from a nozzle, liquid such as ink that has filled a pressure chamber. For example, in JP-A-2013-129191, a structure is disclosed in which a liquid is supplied to a pressure chamber from a common liquid chamber that enables communication between a liquid chamber space portion formed in a communication substrate and a liquid chamber forming space portion of a unit case that fixes on the communication substrate.

In order to reduce the size of a liquid ejecting head it is necessary to decrease the wall thickness of the unit case. However, there is problem in that it is difficult to secure the mechanical strength of the liquid ejecting head due to the decrease in wall thickness.

SUMMARY

An advantage of some aspects of the invention is that the mechanical strength of components that form a space in which liquid is filled is improved.

A liquid ejecting head according to an aspect of the invention includes a pressure chamber substrate in which a pressure chamber space is formed, a flow path substrate having a first surface on which the pressure chamber substrate is installed and a second surface that is on the opposite side to the first surface, and in which a first space, a supply hole that enables communication between the first space and the pressure chamber space, and a communication hole that communicates with the pressure chamber space are formed, a nozzle plate that is installed on the second surface of the flow path substrate and in which a nozzle that communicates with the communication hole is formed, a housing unit that is installed on the first surface of the flow path substrate and in which a second space that communicates with the first space of the flow path substrate is formed, a compliance unit that is flexible and installed on the second surface of the flow path substrate and that seals the communication hole and the first space, and a first beam-like portion that extends between inner wall surfaces of the second space in the housing unit. In the above structure, because the first beam-like portion is installed in the housing unit, it is possible to improve the mechanical strength of the housing unit compared with a structure in which the first beam-like portion is not installed.

Preferably, the first beam-like portion is installed at a position that is separated from the first surface. In the above aspect, it is possible to decrease the likelihood of an adhesive attaching to the first beam-like portion in a process of applying the adhesive to a joining surface of the housing unit that joins to the first surface. Therefore, there is an advantage in that the likelihood of an adhesive that has attached to the first beam-like portion and hardened obstructing the flow of ink in the second space can be reduced.

Preferably, the liquid ejecting head according to the aspect of the invention includes a second beam-like portion that extends between inner wall surfaces of the first space in the flow path substrate. In the above aspect, because the second beam-like portion is installed in the flow path substrate in addition to the first beam-like portion of the housing unit, the above-mentioned effect of increasing the mechanical strength of the liquid ejecting head is particularly improved.

Preferably, the housing unit includes a side surface portion that projects from the second surface along the periphery of the flow path substrate, a top surface portion that is located on the opposite side to the flow path substrate with the second space between the top surface portion and the flow path substrate, and an inlet hole that is formed in the top surface portion and that communicates with the second space, and forms a flow path from the inlet hole toward the side surface portion. In the above aspect, because the flow path is formed from the inlet hole toward the side surface portion inside the housing unit, there is an advantage in that it is possible to secure sufficient volume for the second space.

Preferably, a liquid ejecting apparatus according to an aspect of the invention includes the liquid ejecting head according to the above exemplified aspect. A preferable example of the liquid ejecting apparatus is a printing apparatus that ejects ink, however, the usage of the liquid ejecting apparatus according to the invention is not limited to printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
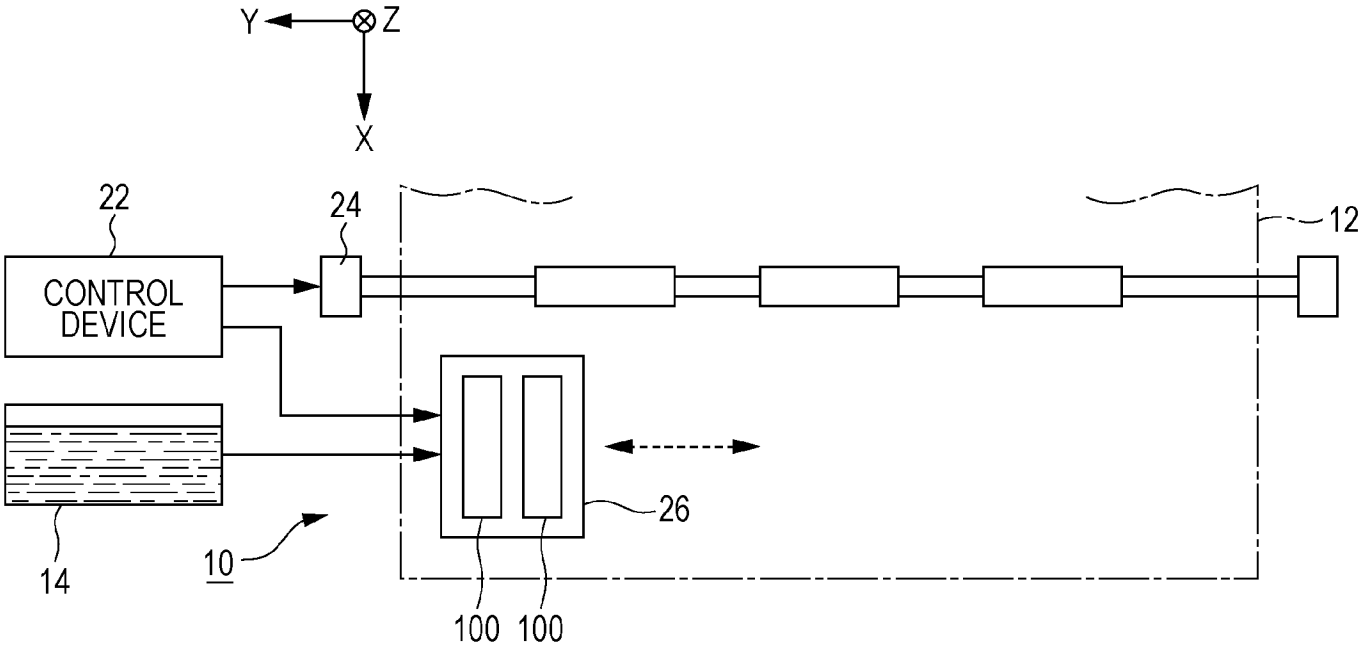
FIG. 1 is a schematic diagram of a printing apparatus according to a first embodiment.

FIG. 1 is a partial schematic diagram of a printing apparatus 10 of an ink jet type according to a first embodiment of the invention. The printing apparatus 10 of the first embodiment is a preferable example of a liquid ejecting apparatus that ejects ink, which is an example of a liquid, onto a medium 12 (ejection target object) such as printing paper, and, as illustrated in FIG. 1, includes a control device 22, a transport mechanism 24, a carriage 26, and a plurality of liquid ejecting heads 100. A liquid container 14 (for example, a cartridge) that stores ink is mounted on the printing apparatus 10.

The control device 22 performs centralized control of the components of the printing apparatus 10. The transport mechanism 24 transports the medium 12 in the X direction under the control of the control device 22. Each of the liquid ejecting heads 100, under the control of the control device 22, ejects ink from a plurality of nozzles to the medium 12. The plurality of liquid ejecting heads 100 are mounted on the carriage 26. The control device 22 causes the carriage 26 to reciprocate in the Y direction, which crosses the X direction. A desired image is formed on the surface of the medium 12 by each of the liquid ejecting heads 100 ejecting ink onto the medium 12 while the medium 12 is being transported by the transport mechanism 24 and the carriage 26 is repeatedly reciprocating. Further, the direction perpendicular to the XY plane (for example, the plane which is parallel to the surface of the medium 12) is hereinafter referred to as the Z direction. The direction of ejection of ink by each of the liquid ejecting heads 100 (typically the vertical direction) corresponds to the Z direction.

Figure 2:
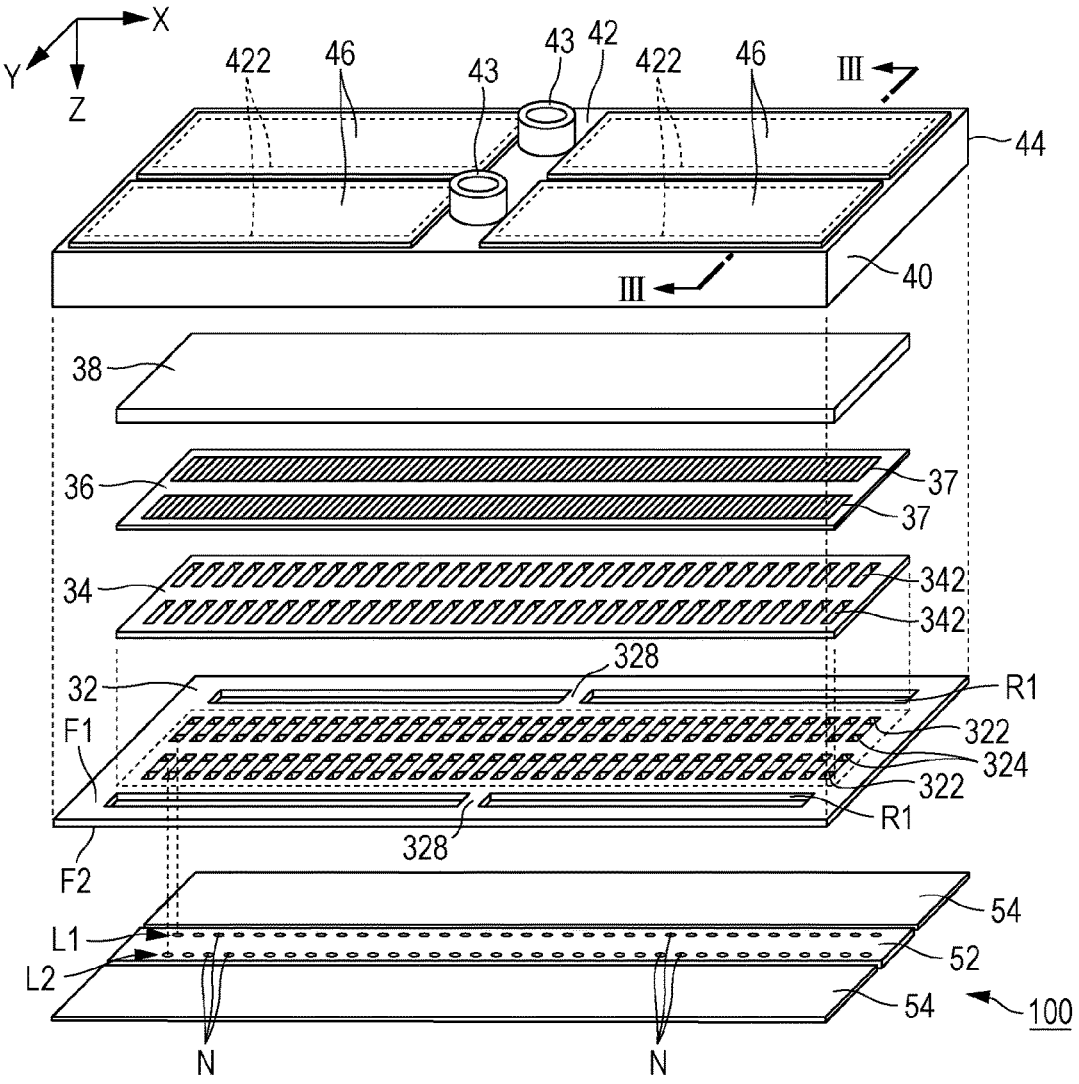
FIG. 2 is an exploded perspective view of a liquid ejecting head.
Figure 3:
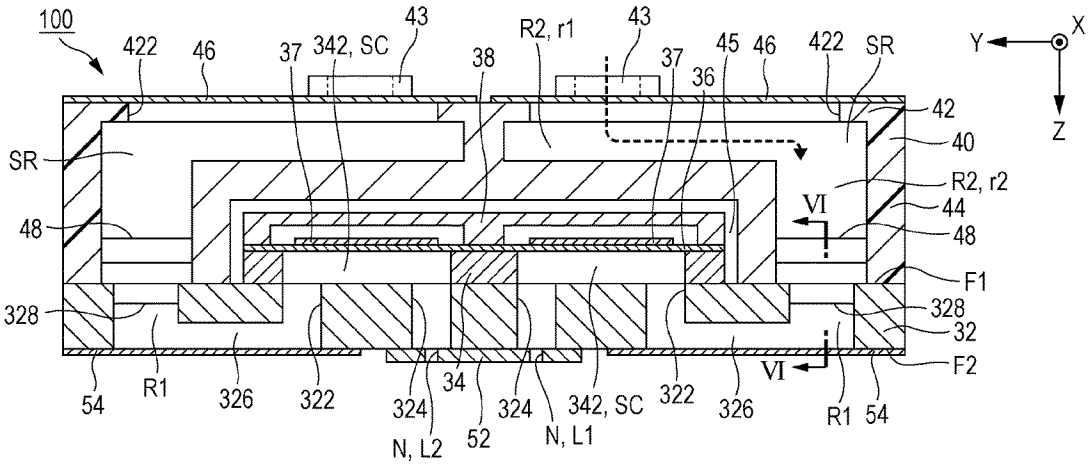
FIG. 3 is a cross-sectional diagram of the liquid ejecting head (cross-sectional diagram taken along the line III-III in FIG. 2).

FIG. 2 is an exploded perspective view of one of the liquid ejecting heads 100, and FIG. 3 is a cross-sectional diagram taken along the line III-III in FIG. 2. As illustrated in FIG. 2, the liquid ejecting head 100 has a plurality of nozzles N that are arranged along the X direction. The plurality of nozzles N of the first embodiment are divided into a first line L1 and a second line L2. The positions of the nozzles N in the X direction differ between the first line L1 and the second line L2. That is, the plurality of nozzles N are in a staggered arrangement. As can be understood from FIG. 2, the liquid ejecting head 100 of the first embodiment is a structure in which components corresponding to the plurality of nozzles N of the first line L1 and components corresponding to the plurality of nozzles N of the second line L2 are arranged so as to be substantially line symmetric. Here, in the description below, components that correspond to each of the nozzles N of the first line L1 are conveniently focused on and descriptions of components that correspond to each of the nozzles N of the second line L2 are suitably omitted.

As illustrated in FIGS. 2 and 3, the liquid ejecting head 100 of the first embodiment has a flow path substrate 32. The flow path substrate 32 is a plate-like member that includes a first surface F1 and a second surface F2. The first surface F1 is a negative-Z-direction-side surface of the flow path substrate 32 and the second surface F2 is a surface that is on the opposite side to the first surface F1 (the positive-Z-direction side). A pressure chamber substrate 34, a vibration portion 36, a plurality of piezoelectric elements 37, a protective member 38 and a housing unit 40 are installed on the first surface F1 of the flow path substrate 32, and a nozzle plate 52 and a compliance unit 54 are installed on the second surface F2 of the flow path substrate 32. The components of the liquid ejecting head 100 are each, schematically, a long plate-like member that extends in the X direction similarly to the flow path substrate 32, and are joined to each other by using, for example, an adhesive.

The nozzle plate 52 is a plate-like member in which a plurality of nozzles N are formed, and is installed on the second surface F2 of the flow path substrate 32 by using, for example, an adhesive. Each of the nozzles N is a hole that allows ink to pass therethrough. The nozzle plate 52 of the first embodiment is manufactured by processing a silicon (Si) single-crystal substrate by using a semiconductor manufacturing technique (for example, etching). However, any known materials and methods may optionally be used in the manufacturing of the nozzle plate 52.

Figure 4:
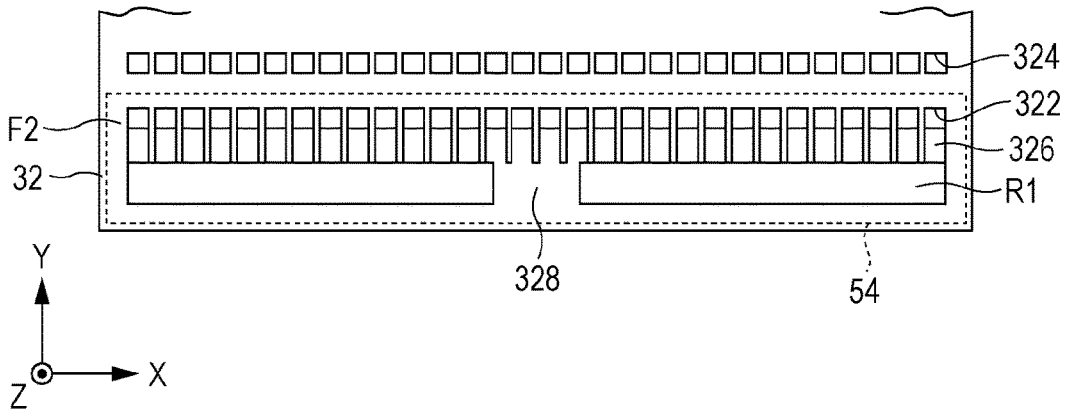
FIG. 4 is a plan view of a flow path substrate.

The flow path substrate 32 is a plate-like member for forming an ink flow path. FIG. 4 is a plan view of the second surface F2 of the flow path substrate 32. As illustrated in FIGS. 2 to 4, spaces R1 (examples of the first space), a plurality of supply holes 322, and a plurality of communication holes 324 are formed in the flow path substrate 32 of the first embodiment. The spaces R1 are openings formed so as to be long and extend in the X direction in plan view (that is, when seen from the Z direction), and the supply holes 322 and the communication holes 324 are through holes that are respectively formed for each one of the nozzles N (that is, openings that extend from the first surface F1 to the second surface F2). The plurality of supply holes 322 are arranged along the X direction and the plurality of communication holes 324 are similarly arranged along the X direction. The array of the plurality of supply holes 322 is located between the array of the plurality of communication holes 324 and the spaces R1. Moreover, as illustrated in FIGS. 3 and 4, a plurality of branch paths 326 that each correspond to a different one of the supply holes 322 are formed in the second surface F2 of the flow path substrate 32. The branch paths 326 are groove-like flow paths that extend in the Y direction so as to link the spaces R1 and the supply holes 322 to each other. In contrast, the communication holes 324 are stacked on corresponding ones of the nozzles N in plan view. That is, the nozzles N communicate with the communication holes 324.

As illustrated in FIGS. 2 and 3, the pressure chamber substrate 34 is a plate-like member in which a plurality of pressure chamber spaces 342 are arranged along the X direction, and is installed on the first surface F1 of the flow path substrate 32 by using, for example, an adhesive. The pressure chamber spaces 342 are long through holes that extend in the Y direction in plan view and are each formed for a corresponding one of the nozzles N. As illustrated in FIG. 3, the positive-Y-direction-side end portion of one of the pressure chamber spaces 342 is stacked on one of the communication holes 324 of the flow path substrate 32 in plan view. Therefore, the pressure chamber space 342 and the nozzle N communicate with each other via the communication hole 324.

In contrast, the negative-Y-direction-side end portion of the one of the pressure chamber spaces 342 is stacked on one of the supply holes 322 of the flow path substrate 32 in plan view. As can be understood from the above description, because the supply holes 322 of the first embodiment function as restrictive flow paths that enable the spaces R1 and the pressure chamber spaces 342 to communicate with each other at a fixed flow path resistance, it is not necessary to form restrictive flow paths in the pressure chamber substrate 34. Here, the pressure chamber spaces 342, which have a simple rectangular form and a fixed flow path width that is constant over the whole length in the Y direction, are formed in the pressure chamber substrate 34 of the first embodiment. That is, restrictive flow paths in which the flow path area has been partially constricted are not formed in the pressure chamber substrate 34. Therefore, compared with a structure in which restrictive flow paths are formed in the pressure chamber substrate 34, the size required for the pressure chamber substrate 34 is reduced and consequently it is possible to achieve size reduction of the liquid ejecting head 100.

The flow path substrate 32 and the pressure chamber substrate 34, as with the nozzle plate 52 mentioned above, are formed by processing a silicon (Si) single-crystal substrate by using, for example, a semiconductor manufacturing technique. However, any known materials and methods may optionally be used in the manufacturing of the flow path substrate 32 and the pressure chamber substrate 34.

As illustrated in FIGS. 2 and 3, the vibration portion 36 is disposed on the surface of the pressure chamber substrate 34 that is on the opposite side to the flow path substrate 32. The vibration portion 36 of the first embodiment is a plate-like member (diaphragm) that is capable of vibrating elastically. Further, in FIGS. 2 and 3, even though a structure in which the vibration portion 36, which is a body separate from the pressure chamber substrate 34, is fixed to the pressure chamber substrate 34 is exemplified, it is possible to form the pressure chamber substrate 34 and the vibration portion 36 as one body by selectively removing a portion, in the thickness direction, of the regions that correspond to the pressure chamber spaces 342 from a plate-like member having a fixed thickness.

As can be understood from FIG. 3, the first surface F1 of the flow path substrate 32 and the vibration portion 36 face each other with a certain distance therebetween inside each of the pressure chamber spaces 342 of the pressure chamber substrate 34. The spaces located between the first surface F1 of the flow path substrate 32 and the vibration portion 36 that are inside the pressure chamber spaces 342 function as pressure chambers SC for applying a pressure to the ink that has been filled into the spaces. The pressure chambers SC are separately formed for each of the nozzles N. As can be understood from the above description, the pressure chamber spaces 342 formed in the pressure chamber substrate 34 are spaces that are to become the pressure chambers SC.

As illustrated in FIGS. 2 and 3, a plurality of the piezoelectric elements 37 that each correspond to a different one of the nozzles N are disposed on the surface of the vibration portion 36 that is on the opposite side to the pressure chambers SC. The piezoelectric elements 37 are passive elements that vibrate when supplied with a driving signal. The plurality of the piezoelectric elements 37 are arranged along the X direction so as to respectively correspond to individual pressure chambers SC. The piezoelectric elements 37 of the first embodiment are formed of a pair of electrodes that face each other and a piezoelectric layer that is stacked between the electrodes. The protective member 38 of FIGS. 2 and 3 is a structure that protects the plurality of the piezoelectric elements 37 and is fixed to the surface of the vibration portion 36 by using, for example, an adhesive. The plurality of the piezoelectric elements 37 are housed inside a space (recess portion) that is formed in a surface of the protective member 38 that faces the vibration portion 36.

The housing unit 40 is a case that stores ink to be supplied to the plurality of the pressure chambers SC. The positive-Z-direction-side surface of the housing unit 40 (hereafter called "joining surface") is fixed to the first surface F1 of the flow path substrate 32 by using, for example, an adhesive. The housing unit 40 of the first embodiment is formed of a material that is different from that of the flow path substrate 32 and the pressure chamber substrate 34. For example, it is possible to manufacture the housing unit 40 by injection-molding a resin material. However, any known materials and methods may optionally be used in the manufacturing of the housing unit 40.

As the material of the housing unit 40, a synthetic fiber such as, for example, polyparaphenylene benzobisoxazole, (Xyron [registered trade name]/hereinafter called PBO fiber) or a resin material such as a liquid crystal polymer may be suitably adopted. However, when considering the various advantages explained below, it is preferable to have a liquid crystal polymer (LCP) as the material of the housing unit 40 over PBO fiber.

Because liquid crystal polymers have a lower linear expansion coefficient than PBO fiber, thermal deformation of the housing unit 40 (particularly warpage relative to the flow path substrate 32) is suppressed.

The occurrence of dimensional errors and shape defects of the housing unit 40 is suppressed because liquid crystal polymers have a lower viscosity than PBO fiber and a higher fluidity than PBO fiber (spread out sufficiently to every part of a die used in injection molding).

Because liquid crystal polymers have a steeper increase in viscosity during the cooling period than PBO fiber (solidification progresses quickly), the occurrence of flash caused by material entering cracks in the die during solidification is reduced and the time necessary to form the housing unit 40 is shortened.

Because liquid crystal polymers have a lower permeability than PBO fiber for a liquid (for example, water) and a gas (for example, water vapor and oxygen), entry of a liquid or a gas into the inside of the housing unit 40 can be suppressed.

Whereas PBO fiber, for example, has a tendency to easily react with solvent ink, because liquid crystal polymers have a low reactivity with many types of ink including solvent ink, deterioration of the housing unit 40 with time caused by adhesion of the ink is suppressed.

Figure 5:
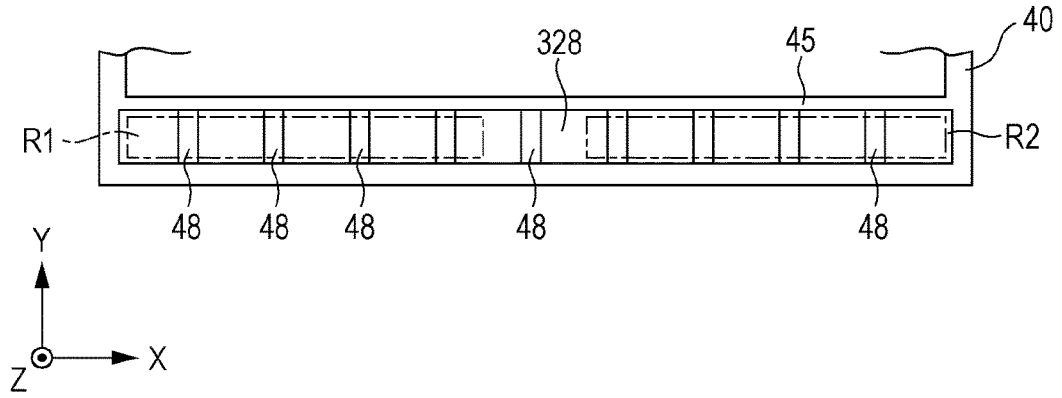
FIG. 5 is a plan view of a housing unit.

FIG. 5 is a plan view of the housing unit 40 seen from the flow path substrate 32 side (positive-Z-direction side). As illustrated in FIGS. 3 and 5, the housing unit 40 of the first embodiment is a structure in which spaces R2 (examples of the second space) are formed. The spaces R2 are recess portions that are open toward the flow path substrate 32 side and are formed so as to be long in the X direction. As illustrated in FIG. 3, the spaces R2 include a first portion r1 and a second portion r2. The second portion r2 is a space on the flow path substrate 32 side (ink flow downstream side) of the first portion r1. Moreover, a housing space 45 that houses the protective member 38 and the pressure chamber substrate 34 is formed between the spaces R2 that correspond to the first line L1 and the spaces R2 that correspond to the second line L2.

As illustrated in FIGS. 2 and 3, the housing unit 40 of the first embodiment includes a top surface portion 42 and a side surface portion 44. The side surface portion 44 is a portion that is fixed to the first surface F1 in such a manner as to project from the first surface F1 of the flow path substrate 32 toward the negative Z direction side along the periphery of the flow path substrate 32. The bottom surface of the side surface portion 44, as a joining surface, is joined to the first surface F1 of the flow path substrate 32. As can be understood from FIG. 3, the outer wall surface of the side surface portion 44 (the surface that is on the opposite side to the inner wall surface on the space R2 side) and the side end surface of the flow path substrate 32 are substantially co-planar (so-called flush). That is, the outer shape of the flow path substrate 32 and the outer shape of the housing unit 40 when seen from the Z direction substantially match each other and the outer shape of the housing unit 40 does not project outside of the periphery of the flow path substrate 32. Therefore, there is an advantage in that, compared with a structure in which the housing unit 40 is larger than the flow path substrate 32, a reduction in the size of the liquid ejecting head 100 can be achieved.

The top surface portion 42 of the housing unit 40 is a portion that is located on the opposite side to the flow path substrate 32 with the spaces R2 between the top surface portion 42 and the flow path substrate 32. The spaces surrounded by the side surface portion 44 and the top surface portion 42 correspond to the spaces R2. As illustrated in FIGS. 2 and 3, inlet holes 43 are formed in the top surface portion 42 of the first embodiment. The inlet holes 43 are tube-like portions that enable the spaces R2 of the housing unit 40 and the outer side of the housing unit 40 to communicate with each other. As can be understood from FIG. 3, the inlet hole 43 of the first embodiment is located on the opposite side (the positive-Y-direction side) to the side surface portion 44 with the second portion r2 of the space R2 between the inlet hole 43 and the side surface portion 44 in plan view, and communicates with the first portion r1 of the space R2.

As illustrated in FIG. 3, the space R1 of the flow path substrate 32 and the space R2 of the housing unit 40 communicate with each other. The space that is formed of both the space R1 and the space R2 functions as a liquid storage chamber SR (reservoir). The liquid storage chamber SR is a common liquid chamber that extends across a plurality of nozzles N, and stores ink that has been supplied from the liquid container 14 to the inlet hole 43. As described above, the inlet hole 43 is located on the positive-Y-direction side of the second portion r2. Therefore, the ink supplied from the liquid container 14 to the inlet hole 43 flows, as indicated by a dashed arrow in FIG. 3, toward the side surface portion 44 side (negative Y direction side) within the first portion r1 of the space R2 and, after arriving at the second portion r2, flows toward the positive Z direction side within the second portion r2. That is, a flow path from the inlet holes 43 in a direction toward the side surface portion 44 is formed within the housing unit 40. Then, the ink stored in the liquid storage chambers SR after having branched into the plurality of branch paths 326 passes through the supply holes 322 and is supplied to and fills each of the pressure chambers SC, and, as a result of a change in pressure caused by the vibration portions 36, passes from the pressure chambers SC to the communication holes 324 and the nozzles N and is ejected to the outside. That is, the pressure chamber SC functions as a space that generates a pressure in order to eject ink from the nozzle N, and the liquid storage chamber SR functions as a space (common liquid chamber) that stores ink to be supplied to the plurality of the pressure chambers SC.

As illustrated in FIGS. 2 and 3, the compliance units 54 are installed on the second surface F2 of the flow path substrate 32. Each of the compliance units 54 is a flexible film and functions as a vibration absorber that absorbs changes in the pressure of the ink inside the liquid storage chamber SR (space R1). As illustrated in FIG. 3, the compliance units 54 are installed on the second surface F2 of the flow path substrate 32 so as to seal the spaces R1 of the flow path substrate 32, the plurality of the branch paths 326, and the plurality of the supply holes 322 and form the bottom surface of the liquid storage chamber SR. That is, the pressure chambers SC face the compliance units 54 through the supply holes 322. Further, in the example of FIG. 2, although the space R1 corresponding to the first line L1 and the space R1 corresponding to the second line L2 are sealed by separate ones of the compliance units 54, it is possible to seal both of the spaces R1 with one of the compliance units 54.

In contrast, as illustrated in FIGS. 2 and 3, opening portions 422 are formed in the top surface portion 42 of the housing unit 40. Specifically, the opening portions 422 are formed on the positive and negative X direction sides with the inlet holes 43 therebetween. The opening portions 422 are openings that enable communication between the spaces R2 of the housing unit 40 and the outer portion spaces of the housing unit 40. As illustrated in FIG. 2, compliance units 46 are arranged on the surface of the top surface portion 42. Each of the compliance units 46 is a flexible film that functions as an absorber that absorbs changes in the pressure of the ink in the liquid storage chamber SR (space R2), is installed on the outer wall surface of the top surface portion 42 so as to seal the opening portion 422, and forms a wall surface (specifically, the top surface) of the liquid storage chamber SR. The compliance unit 46 of the first embodiment is located within the liquid storage chamber SR on the upstream side of the compliance unit 54 and is arranged parallel to the first surface F1 of the flow path substrate 32 and the compliance unit 54. Further, in the example of FIG. 2, the compliance units 46 are separately mounted on corresponding ones of the opening portions 422, however, a structure in which one of the compliance units 46 is continuous over a plurality of the opening portions 422 can be adopted. As can be understood from the above description, in the first embodiment, the compliance units 54 and the compliance units 46 are installed in order to suppress a change in the pressure of the liquid storage chambers SR.

As illustrated in FIGS. 2 to 4, beam-like portions 328 (examples of the second beam-like portion) are mounted in the spaces R1 of the flow path substrate 32. In the first embodiment, one of the beam-like portions 328 is formed at a position that is in the center of the space R1 in the X direction. The beam-like portion 328 is a beam-like portion that extends in the Y direction between a pair of inner wall surfaces of the space R1 that face each other with a certain distance therebetween. That is, the beam-like portion 328 is formed in a shape such that it projects in the Y direction from one of the inner wall surfaces of the pair of inner wall surfaces of the space R1, which are parallel to the X-Z plane, and reaches the other inner wall surface. As illustrated in FIGS. 2 and 4, it is also possible to represent the space R1 as a structure that is divided into two spaces by the beam-like portion 328 serving as a boundary. The beam-like portions 328 of the first embodiment are formed as one with the flow path substrate 32 by processing the silicon single-crystal substrate. Further, even though a structure that forms one of the beam-like portions 328 in the space R1 is exemplified in FIG. 4, it is possible to form a plurality of the beam-like portions 328 spaced apart from each other at intervals in the X direction in the space R1.

As illustrated in FIGS. 3 and 5, a plurality of beam-like portions 48 (examples of the first beam-like portion) are formed in the space R2 of the housing unit 40. Each of the beam-like portions 48 is a beam-like portion that extends in the Y direction between a pair of inner wall surfaces of the space R2 that face each other with a certain distance therebetween. That is, the beam-like portion 48 is formed in a shape such that it projects in the Y direction from one of the inner wall surfaces of the pair of inner wall surfaces of the space R2, which are parallel to the X-Z plane, and reaches the other inner wall surface. A plurality of the beam-like portions 48 that are spaced apart from each other at a certain interval along the X direction are installed in the spaces R2. That is, in the first embodiment, the beam-like portions 48, the number of which is more than that of the beam-like portions 328 of the flow path substrate 32, are installed in the housing unit 40. The beam-like portions 328 of the first embodiment are, for example, formed as one body with the housing unit 40 by injection-molding a resin material.

Figure 6:
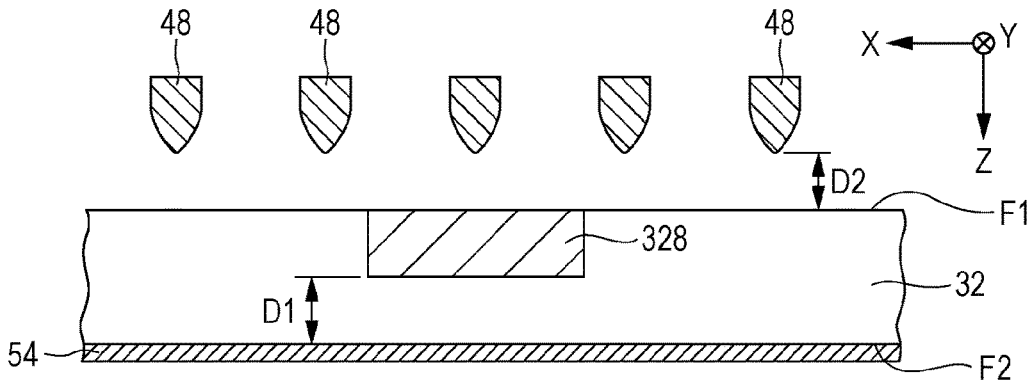
FIG. 6 is a cross-sectional diagram of the housing unit and the flow path substrate (cross-sectional diagram taken along the line VI-VI in FIG. 3).

FIG. 6 is a cross-sectional diagram taken along the line VI-VI in FIG. 3. That is, the structure of the section that cuts through the space R1 of the flow path substrate 32 and the space R2 of the housing unit 40 is illustrated in FIG. 6. As illustrated in FIG. 6, the upper surface of the beam-like portion 328 is located within the same plane as the first surface F1 of the flow path substrate 32 and the lower surface of the beam-like portion 328 is located between the first surface F1 and the second surface F2. Therefore, the beam-like portion 328 and the compliance unit 54 face each other in the Z direction with a certain distance D1 therebetween.

As illustrated in FIG. 6, the surface of each of the beam-like portions 48 of the housing unit 40 on the flow path substrate 32 side is an inclined surface that is inclined with respect to the first surface F1 (X-Y plane) of the flow path substrate 32. Specifically, the surface of the beam-like portion 48 of the first embodiment includes a pair of inclined surfaces (level or curved surfaces) that are located on the positive and negative X direction sides so as to form a ridge that is parallel to the Y direction. That is, the width (dimension in the X direction) of the beam-like portion 48 gradually decreases from the negative Z direction side to the positive Z direction side. As can be understood from FIG. 6, the beam-like portion 328 of the flow path substrate 32 is wider than the beam-like portion 48 of the housing unit 40. Moreover, as can be understood from FIG. 6, the plurality of the beam-like portions 48 of the housing unit 40 are mounted at a position separated from the first surface F1 of the flow path substrate 32 on the negative Z direction side (opposite side to the flow path substrate 32). Specifically, a fixed distance D2 between each of the beam-like portions 48 and the first surface F1 is secured. As described above, because the joining portion of the housing unit 40 is joined to the first surface F1, it can be said, in other words, that each of the beam-like portions 48 and the joining surface are separated by the distance D2.

Figure 7:
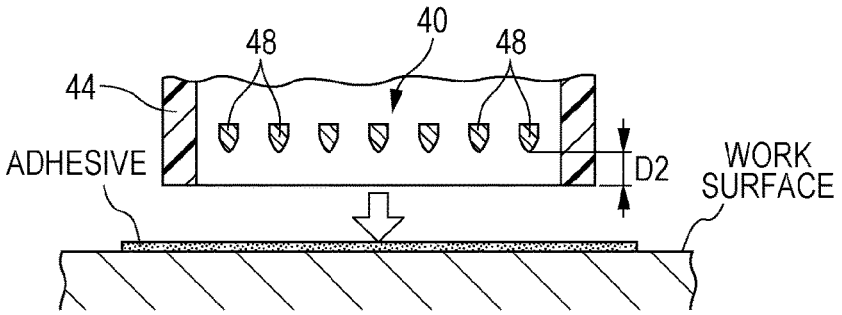
FIG. 7 is an explanatory diagram of the process for installing the housing unit on the flow path substrate.

FIG. 7 is an explanatory diagram of the process for installing the housing unit 40 on the first surface F1 of the flow path substrate 32. As illustrated in FIG. 7, by mounting the housing unit 40 on a work surface on which adhesive has been applied in a uniform thickness, the adhesive is transferred to a joining surface of the housing unit 40 (for example, the bottom surface of the side surface portion 44) and by arranging the housing unit 40, which has had the adhesive transferred thereto, on the first surface F1 of the flow path substrate 32, the housing unit 40 is joined to the flow path substrate 32. In the first embodiment, because a plurality of the beam-like portions 48 are installed at a position away from the joining surface of the housing unit 40 by a distance D2, in the process of mounting the housing unit 40 on the work surface illustrated in FIG. 7, the likelihood of the adhesive attaching to both the joining surface, which is the original transfer target of the adhesive, and the beam-like portions 48 is decreased. Therefore, there is an advantage in that the likelihood of adhesive that has attached to the beam-like portions 48 and hardened obstructing the flow of ink in the liquid storage chambers SR can be reduced.

As explained above, in the first embodiment, because the liquid storage chamber SR and the pressure chamber SC are in communication with each other through the supply hole 322 (restrictive flow path) formed in the flow path substrate 32, the required size of the pressure chamber substrate 34 can be reduced compared with a structure in which a restrictive flow path is formed in the pressure chamber space 342. Therefore, it is possible to achieve a reduction in the size of the liquid ejecting head 100. Moreover, because the compliance units 54 are installed with the communication holes 324 therebetween at positions near the pressure chambers SC so as to face the pressure chambers SC, there is an advantage in that the compliance units 54 can effectively absorb pressure changes that propagate from each of the pressure chambers SC to the liquid storage chamber SR through the supply holes 322. However, in the structure in which the size of the flow path substrate 32 has been reduced in order to reduce the size of the liquid ejecting heads 100, it is difficult to secure a sufficient area for the compliance units 54 and it is expected that there is a chance that the pressure change in the liquid storage chambers SR cannot be sufficiently suppressed by only using the compliance units 54. In the first embodiment, because the compliance units 46 are installed in the housing unit 40 in addition to the compliance units 54 of the flow path substrate 32, compared with a structure in which the compliance units 46 are not installed, there is an advantage in that the pressure change in the liquid storage chambers SR can be effectively suppressed even in the case where the flow path substrate 32 has been reduced in size.

On the other hand, it is necessary to reduce the size of the housing unit 40 in order to reduce the size of the liquid ejecting heads 100, however, in the case where the thickness of the side surface portion 44 and the top surface portion 42 is reduced in order to reduce the size of the housing unit 40, there is a chance that the mechanical strength of the housing unit 40 will be insufficient. In the first embodiment, because the beam-like portions 48 are installed in the housing unit 40, there is an advantage in that the mechanical strength of the housing unit 40 can be maintained even in a structure in which the thickness of each portion has been reduced in order to reduce the size of the housing unit 40. In the first embodiment, because the beam-like portions 328 are installed in the flow path substrate 32 in addition to the beam-like portions 48 of the housing unit 40, there is an advantage in that the mechanical strength of the flow path substrate 32 (consequently the overall strength of the liquid ejecting heads 100) can be maintained.

Second Embodiment

A second embodiment of the invention will be described. Components of each of the examples given below that have the same operations and functions as those of the first embodiment are designated by the same reference symbols as used in the description of the first embodiment and detailed description thereof is omitted.

Figure 8:
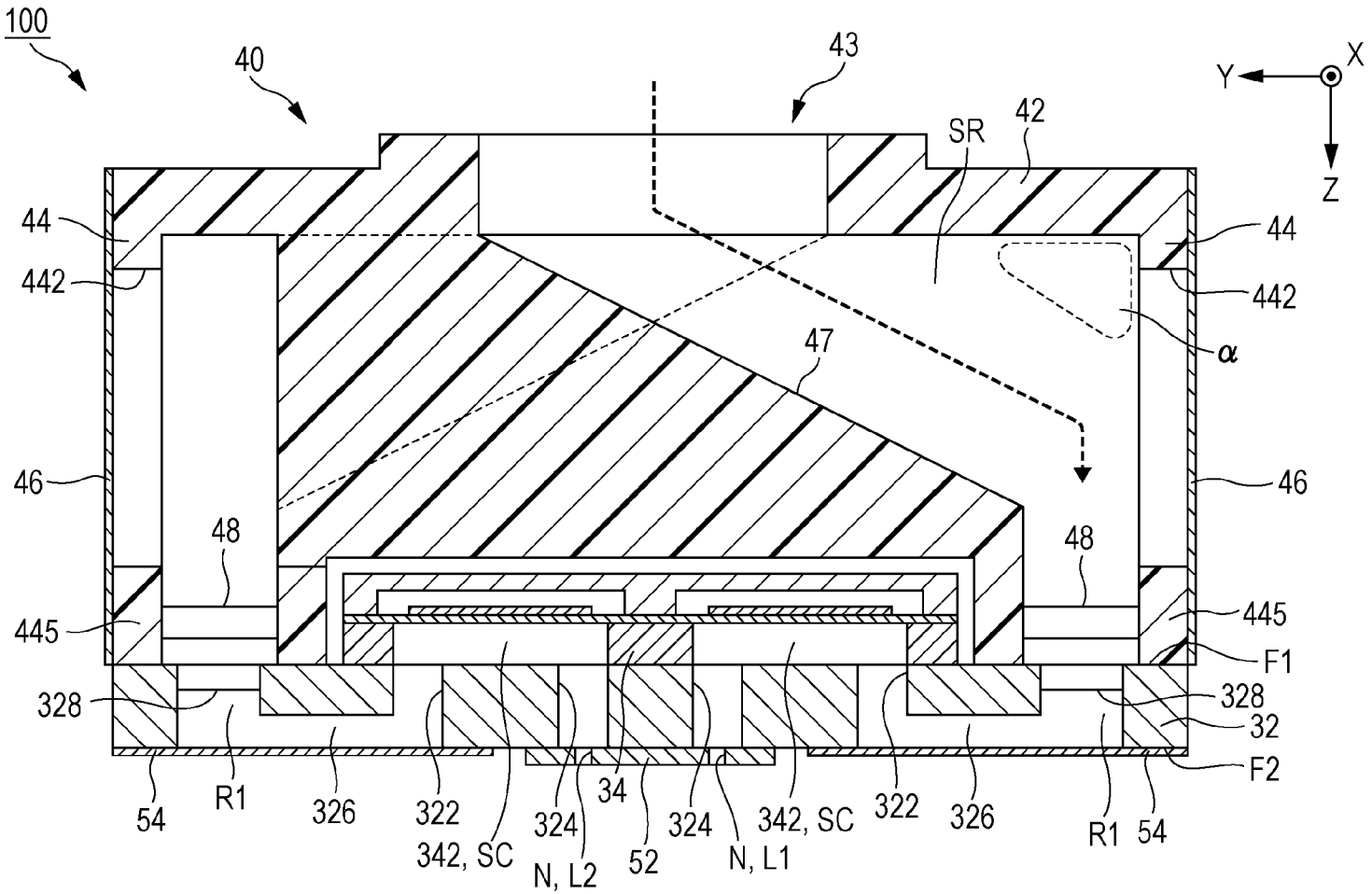
FIG. 8 is a cross-sectional diagram of a liquid ejecting head of a second embodiment.
Figure 9:
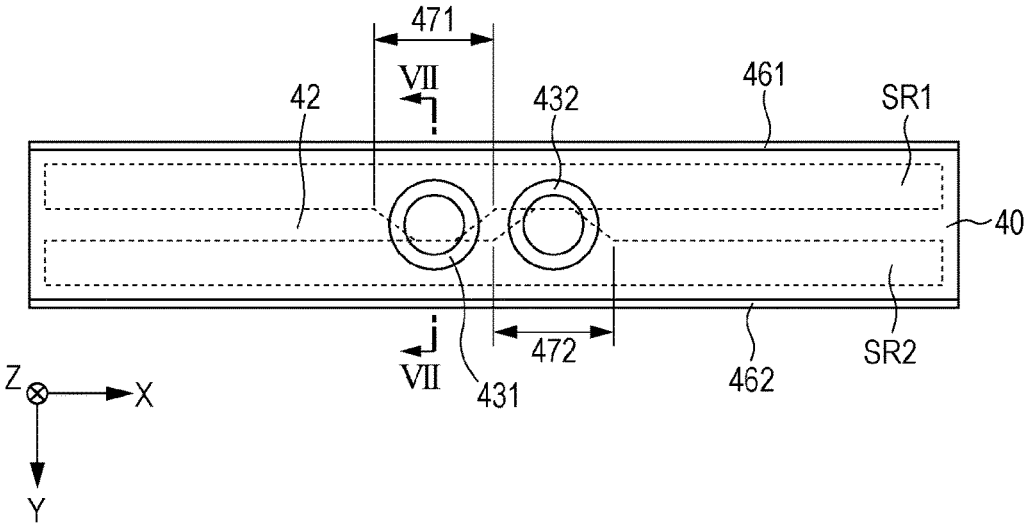
FIG. 9 is a plan view of the liquid ejecting head of the second embodiment.

FIG. 8 is a cross-sectional diagram of one of the liquid ejecting heads 100 of the second embodiment and FIG. 9 is a plan view of one of the liquid ejecting heads 100 as seen from the negative Z direction side. In FIG. 9, an additional "1" is added after the reference symbols for components corresponding to the plurality of the nozzles N of the first line L1, and an additional "2" is added after the reference symbols for components corresponding to the plurality of the nozzles N of the second line L2. As illustrated in FIG. 9, in the top surface portion 42 of the housing unit 40 of the liquid ejecting heads 100 of the second embodiment, inlet holes 431 corresponding to the plurality of the nozzles N of the first line L1 and inlet holes 432 corresponding to the plurality of the nozzles N of the second line L2 are arranged along the X direction. Similarly to the first embodiment, the housing unit 40 of the second embodiment is formed of a resin material such as, for example, a liquid crystal polymer.

The inner wall surfaces of the liquid storage chamber SR1 (space R2) that corresponds to the first line L1 include an inclined surface 471 that extends, in plan view, from the inlet hole 431 toward the negative Y direction side, and the inner wall surfaces of the liquid storage chamber SR2 that corresponds to the second line L2 include an inclined surface 472 that extends, in plan view, from the inlet hole 432 of the second line L2 toward the positive Y direction side. As can be understood from FIG. 8, the inclined surface 471 and the inclined surface 472 are level or curved surfaces that are inclined in the X-Y plane. As can be understood from the above description, ink supplied from the liquid container 14 to the inlet hole 43 flows, as indicated by a dashed arrow in FIG. 8, toward the side surface portion 44 side (negative Y direction side) along an inclined surface 47 in the liquid storage chamber SR.

In contrast to the opening portions 422 formed in the top surface portion 42 of the housing unit 40 of the first embodiment, in the second embodiment, as illustrated in FIG. 8, the opening portions 442 are formed in the side surface portion 44 of the housing unit 40. Specifically, the side surface portion 44 is formed so as to have a rectangular frame-like shape having, as a base, a base portion 445 that extends in the X direction along the periphery of the flow path substrate 32. The bottom surface of the base portion 445, as a joining surface, is joined to the first surface F1 of the flow path substrate 32 by using, for example, adhesive. Therefore, the base portion 445 projects from the first surface F1 toward the negative Z direction side. As illustrated in FIG. 8, the compliance units 46 of the second embodiment seal the opening portions 442 in the outer wall surface of the side surface portion 44. That is, the compliance units 46 are fixed to the rectangular-frame-like outer wall surface that includes the surface of the base portion 445. The structure in which the compliance units 54 are installed on the second surface F2 of the flow path substrate 32 is the same as that of the first embodiment. That is, the compliance units 46 of the second embodiment are arranged perpendicular to the first surface F1 of the flow path substrate 32 and the compliance units 54. As can be understood from the above description, in the second embodiment as in the first embodiment, the compliance units 54 installed in the flow path substrate 32 and the compliance units 46 installed in the housing unit 40 are both used to absorb pressure changes in the liquid storage chambers SR.

As illustrated in FIG. 8, the plurality of the beam-like portions 48, which are the same as those in the first embodiment, are installed on the inner wall surface of the base portion 445 in the side surface portion 44. Specifically, the plurality of the beam-like portions 48 are arranged so as to be separated from each other at a certain interval along the base portion 445 that extends in the X direction. The plurality of the beam-like portions 48 are located away from the first surface F1 (or the joining surface, which is the bottom surface of the base portion 445) of the flow path substrate 32 on the negative Z direction side by a distance D2. The structure of the beam-like portions 328 of the flow path substrate 32 is the same as that of the first embodiment.

The second embodiment achieves the same effect as the first embodiment. In the second embodiment, because the opening portions 442 are formed in the side surface portion 44, there is a tendency for the mechanical strength to be insufficient in the side surface portion 44, in particular, the base portion 445. In the second embodiment, because the beam-like portions 48 are installed in the base portion 445, there is an advantage in that the mechanical strength of the base portion 445 can be effectively reinforced.

Moreover, in the second embodiment, because the compliance units 46 are installed in the side surface portion 44 of the housing unit 40, compared with the first embodiment in which the compliance units 46 are installed in the top surface portion 42, it is possible to improve the capability to absorb pressure changes in the liquid storage chambers SR while reducing the size (size in the X-Y plane) of the liquid ejecting heads 100 seen from the Z direction. However, in the first embodiment, because the compliance units 46 are installed in the top surface portion 42, compared with the second embodiment in which the compliance units 46 are installed in the side surface portion 44, there is an advantage in that the capability to absorb pressure changes in the liquid storage chambers SR can be secured while reducing the height (size in the Z direction) of the housing unit 40. Moreover, as the height of the housing unit 40 decreases, for example, the distance required to move bubbles mixed with the ink in the liquid storage chambers SR in order to discharge the bubbles from the nozzles N shortens. That is, from the viewpoint of discharging bubbles, the first embodiment is better than the second embodiment.

Further, for example, in a structure in which the side surface portion 44 of the housing unit 40 does not include the base portion 445 (for example, a structure in which the bottom of the opening portions 442 is fixed to the first surface F1 of the flow path substrate 32, called "comparison example" below), the compliance unit 46 is installed across the outer wall surface of the side surface portion 44 and the side end surface of the flow path substrate 32. In the second embodiment, because the compliance unit 46 is installed in the outer wall surface of the side surface portion 44 that includes a surface of the base portion 445 of the housing unit 40, compared with the comparison example in which the compliance unit 46 extends across both of the outer wall surface of the side surface portion 44 and the side end surface of the flow path substrate 32, the compliance unit 46 is strongly fixed. Therefore, there is an advantage in that the likelihood of a malfunction occurring such as leakage of ink from the joining portion of the compliance unit can be reduced.

Third Embodiment

Figure 10:
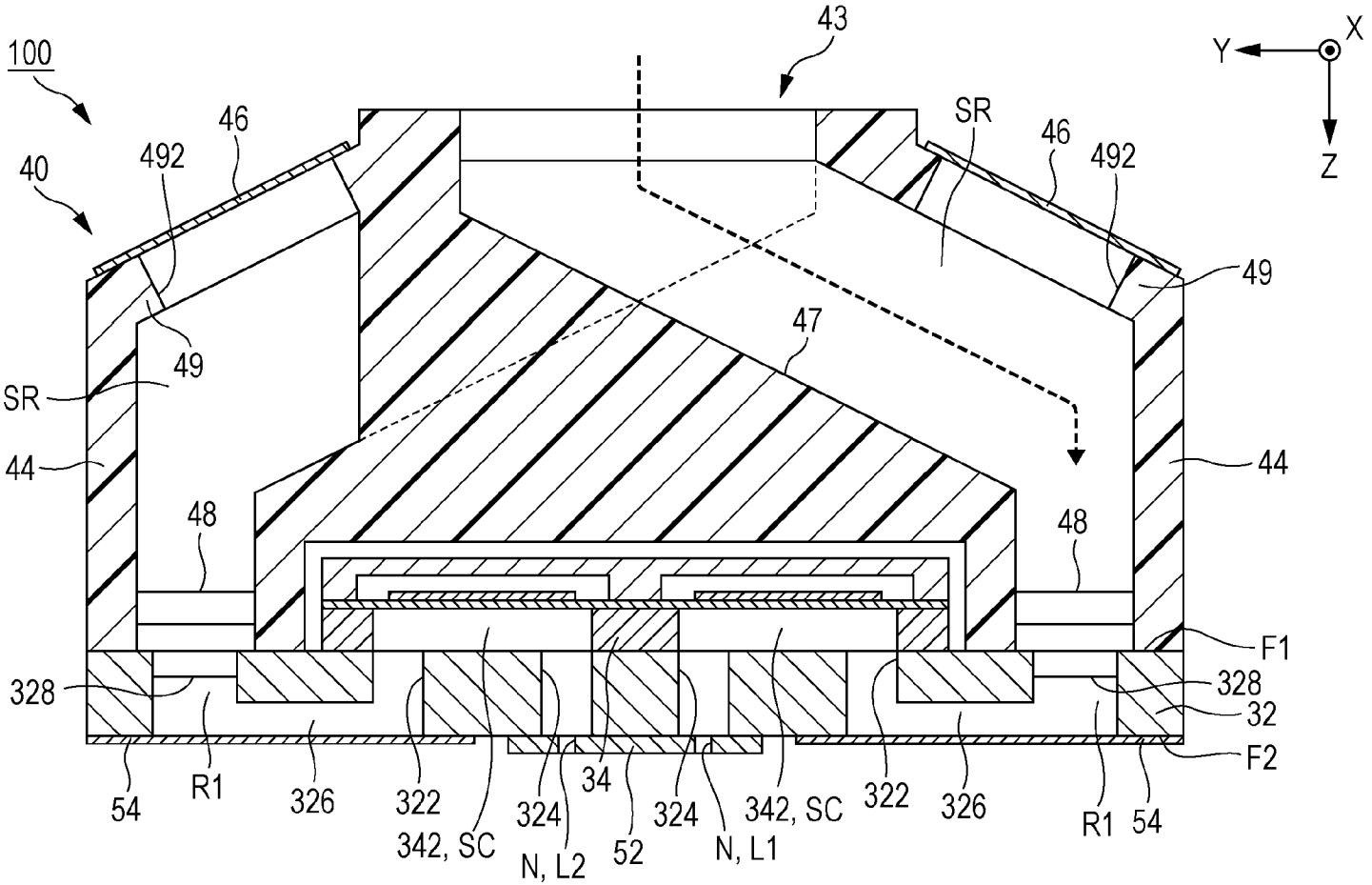
FIG. 10 is a cross-sectional diagram of a liquid ejecting head of a third embodiment.

FIG. 10 is a cross-sectional diagram of one of the liquid ejecting heads 100 of the third embodiment. In the housing unit 40 of the third embodiment, as in the second embodiment illustrated in FIG. 9, two of the inlet holes 43 are arranged along the X direction and the inner wall surface of the liquid storage chambers SR include the inclined surfaces 47 (471 and 472). As illustrated in FIG. 10, the housing unit 40 of the liquid ejecting head 100 of the third embodiment includes an inclined portion 49, which is an outer wall surface inclined with respect to the first surface F1 (X-Y plane) of the flow path substrate 32. Specifically, the inclined portion 49 is a portion that is substantially parallel to the inclined surface 47 of the liquid storage chamber SR. Similarly to the first embodiment, the housing unit 40 of the third embodiment is formed of a resin material such as, for example, a liquid crystal polymer.

In the third embodiment, an opening portion 492 is formed in the inclined portion 49 of the housing unit 40. The compliance unit 46 of the third embodiment seals the opening portion 492 in the outer wall surface of the inclined portion 49. The structure in which the compliance unit 54 is installed on the second surface F2 of the flow path substrate 32 is the same as that of the first embodiment. Therefore, the compliance unit 46 of the second embodiment is inclined with respect to the first surface F1 of the flow path substrate 32 and the compliance unit 54. As can be understood from the above description, in the third embodiment as in the first embodiment, the compliance unit 54 installed in the flow path substrate 32 and the compliance unit 46 installed in the housing unit 40 can both be used to absorb pressure changes in the liquid storage chamber SR. Further, the structures of the beam-like portions 328 of the flow path substrate 32 and the beam-like portions 48 of the housing unit 40 are the same as those of the first embodiment.

The third embodiment achieves the same effect as the first embodiment. In the third embodiment, the compliance unit 46 is installed on the outer wall surface of the inclined portion 49 of the housing unit 40. Therefore, for example, there is an advantage in that, compared with a structure in which the compliance unit 46 is installed parallel to the flow path substrate 32 as in the first embodiment, the size of the liquid ejecting head 100 in the X-Y plane is reduced, and compared with a structure in which the compliance unit 46 is installed perpendicular to the flow path substrate 32 as in the second embodiment, the size of the liquid ejecting head 100 in the Z direction can be reduced.

Further, for example, as in the first embodiment and the second embodiment, in a structure in which the top surface portion 42 and the side surface portion 44 are substantially orthogonal to each other, there is a tendency for ink to remain in a portion (for example, the region a of FIG. 8) on the inside of a corner formed by the top surface portion 42 and the side surface portion 44 in the liquid storage chamber SR. In the third embodiment, because the housing unit 40 includes the inclined portion 49, compared with the first embodiment and the second embodiment, smooth flow of the ink in the liquid storage chamber SR is promoted. Therefore, there is an advantage in that the likelihood of bubbles, which are mixed with the ink, remaining in the liquid storage chamber SR can be reduced.

Modification Examples

The above-described embodiments can be modified in various ways. Specific examples of the modifications will be described below. Two or more examples chosen from the following examples can be combined appropriately as long as they do not contradict each other.

Figure 11:
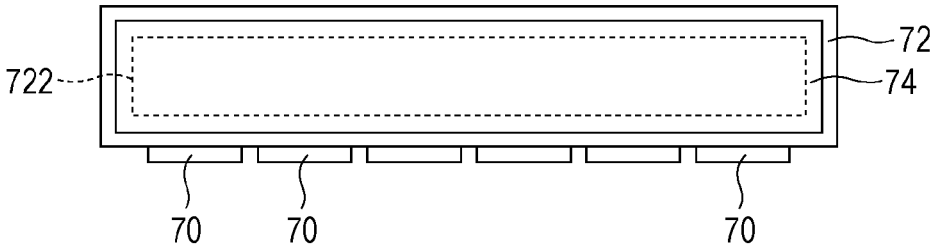
FIG. 11 is a schematic diagram of a liquid ejecting head according to a modification example.

(1) In each of the above-mentioned embodiments, the flow path substrate 32 is installed in the housing unit 40, however, as illustrated in FIG. 11, it is possible to install a plurality of the flow path substrates 32 in a housing unit 72. Each of a plurality of liquid ejecting units 70 illustrated in FIG. 11 has the components of the liquid ejecting head 100 of each of the above-mentioned embodiments except for the housing unit 40. That is, one of the liquid ejecting units 70 (head chips) is provided with the flow path substrate 32, the pressure chamber substrate 34, the vibration portion 36, a plurality of the piezoelectric elements 37, the protective member 38, the nozzle plate 52, and the compliance units 54. As illustrated in FIG. 11, the housing unit 72 is installed so as to house all the flow path substrates 32 of the plurality of the liquid ejecting units 70. In the housing unit 72, a plurality of spaces R2 (not illustrated) that correspond to different ones of the liquid ejecting units 70 are formed and communicate with the spaces R1 of the flow path substrate 32 of each of the liquid ejecting units 70. On the side surface of the housing unit 72, an opening portion 722 that extends across the plurality of liquid ejecting units 70 is formed, and a compliance unit 74 that seals the opening portion 722 is installed on the outer wall surface of the housing unit 72. That is, the compliance unit 74 is used in common across a plurality of the liquid ejecting units 70. According to the structure of FIG. 11, there is an advantage in that the structure of the liquid ejecting heads 100 is simplified compared with a structure in which the housing unit 72 and the compliance unit 74 are separately installed in each of the liquid ejecting units 70. Further, in FIG. 11, the compliance unit 74 is installed on the side surface of the housing unit 72; however, it is also possible to install the compliance unit 74 across the plurality of liquid ejecting units 70 on the top surface (upper surface) of the housing unit 72.

(2) In the first embodiment, the compliance units 46 are installed on the top surface portion 42 of the housing unit 40, and, in the second embodiment, the compliance units 46 are installed on the side surface portion 44 of the housing unit 40, however, it is possible to install the compliance units 46 on both the top surface portion 42 of the housing unit 40 and the side surface portion 44. Moreover, a structure in which the compliance units 46 are installed on the inclined portion 49 exemplified in the third embodiment and at least one of the top surface portion 42 and the side surface portion 44 of the housing unit 40 may be adopted. Further, it is also possible to omit at least one of the compliance units 54 and the compliance units 46.

(3) Components that apply a pressure inside the pressure chambers SC (driver elements) are not limited to the piezoelectric elements 37 exemplified in each of the above-mentioned embodiments. For example, it is possible to use, as driver elements, heater elements that generate bubbles and cause a change in the pressure inside the pressure chambers SC by heat. As can be understood from the above examples, the driver elements comprehensively represent elements for ejecting a liquid (typically, elements that apply a pressure inside the pressure chambers SC) and there are no particular limitations on the operation method (piezoelectric method/heating method) and specific structure.

(4) In each of the above-mentioned embodiments, the beam-like portions 48 are formed as one with the housing unit 40, however, it is possible to fix the beam-like portions 48 that are separate from the housing unit 40 to the housing unit 40. The same is true for the beam-like portions 328 of the flow path substrate 32; it is possible to fix the beam-like portions 328 that are separate from the flow path substrate 32 to the flow path substrate 32.

(5) In each of the above-mentioned embodiments, the carriage 26 on which a plurality of the liquid ejecting heads 100 are mounted is given as an example of a serial head that moves in the Y direction, however, it is possible to also apply line heads in which a plurality of the liquid ejecting heads 100 are arranged along the Y direction to the invention.

(6) The printing apparatus 10 described in each of the above embodiments may be adopted in a printing-only device or any one of various devices such as a facsimile device, a photocopier or the like. However, the use of the liquid ejecting apparatus of this invention is not limited to printing. For example, a liquid ejecting apparatus that ejects solutions of color materials can be used as a manufacturing device for forming the color filters of liquid crystal displays.

Moreover, a liquid ejecting apparatus that ejects a solution of a conductive material can be used as a manufacturing device for forming wiring or electrodes of a wiring substrate or the like.

What is claimed is:

1. A liquid ejecting head comprising:

a pressure chamber substrate in which a pressure chamber space is formed and which is associated with a piezoelectric element, a flow path substrate having a first surface on which the pressure chamber substrate is installed and a second surface that is on the opposite side to the first surface, wherein a first space, a supply hole that enables communication between the first space and the pressure chamber space, and a communication hole that communicates with the pressure chamber space are formed in the flow path substrate, a nozzle plate that is installed on the second surface of the flow path substrate, wherein a nozzle that communicates with the communication hole is formed in the nozzle plate, a housing unit that is installed on the first surface of the flow path substrate, wherein a second space that communicates with the first space of the flow path substrate is formed in the housing unit, wherein the piezoelectric element is positioned between the housing unit and the pressure chamber substrate, a compliance unit that is flexible and installed on the second surface of the flow path substrate and that seals the first space, a first beam-like portion that extends between inner wall surfaces of the second space in the housing unit, and a second beam-like portion that extends between inner wall surfaces of the first space in the flow path substrate at a location where the housing unit is installed on the first surface, wherein the first beam-like portion is above the second beam-like portion in a direction that liquid flows in the first and second spaces, and wherein a number of the first beam-like portions is more than a number of the second beam-like portions.

2. The liquid ejecting head according to claim 1, wherein the first beam-like portion is installed at a position that is separated from the first surface.

3. A liquid ejecting apparatus comprising: the liquid ejecting head according to claim 2.

4. The liquid ejecting head according to claim 1, wherein the housing unit includes a side surface portion that is installed on the first surface along the periphery of the flow path substrate, a top surface portion that is located on the opposite side to the flow path substrate with the second space between the top surface portion and the flow path substrate, and an inlet hole that is formed in the top surface portion and that communicates with the second space, and forms a flow path from the inlet hole toward the side surface portion.

5. A liquid ejecting apparatus comprising: the liquid ejecting head according to claim 4.

6. A liquid ejecting apparatus comprising: the liquid ejecting head according to claim 1.

* * * * *